US009659727B2

(12) United States Patent
Kanaya et al.

(10) Patent No.: US 9,659,727 B2
(45) Date of Patent: May 23, 2017

(54) SWITCH

(71) Applicant: Kabushiki Kaisha Toshiba, Minato-ku (JP)

(72) Inventors: Kazuhisa Kanaya, Yokohama (JP); Yoshiaki Ohda, Yokohama (JP); Tadashi Koshizuka, Saitama (JP); Masayuki Sato, Yokohama (JP); Yuki Matsui, Ota (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/914,496

(22) PCT Filed: Jul. 9, 2014

(86) PCT No.: PCT/JP2014/068262
§ 371 (c)(1),
(2) Date: Apr. 18, 2016

(87) PCT Pub. No.: WO2015/029606
PCT Pub. Date: Mar. 5, 2015

(65) Prior Publication Data

US 2016/0225557 A1 Aug. 4, 2016

(30) Foreign Application Priority Data

Aug. 26, 2013 (JP) ..... 2013-174419

(51) Int. Cl.
*H01H 33/666* (2006.01)
*H01H 33/04* (2006.01)
(Continued)

(52) U.S. Cl.
CPC ..... *H01H 33/04* (2013.01); *H01H 33/143* (2013.01); *H01H 33/38* (2013.01);
(Continued)

(58) Field of Classification Search
CPC .... H01H 31/003; H01H 33/16; H01H 33/666; H01H 33/6661; H01H 33/56;
(Continued)

(56) References Cited

U.S. PATENT DOCUMENTS 3,824,361 A * 7/1974 Noack ..... H01H 3/46 218/84
3,839,612 A * 10/1974 Badey ..... H01H 33/6661 218/4
(Continued)

FOREIGN PATENT DOCUMENTS

JP 58-209830 A 12/1983
JP 2003-348721 A 12/2003
(Continued)

OTHER PUBLICATIONS

International Search Report Issued Oct. 7, 2014 in PCT/JP2014/068262.

*Primary Examiner* — Truc Nguyen
(74) *Attorney, Agent, or Firm* — Oblon, McClelland, Maier & Neustadt, L.L.P.

(57) ABSTRACT

A switch capable of easily accomplishing current cutoff roles required for a high-voltage switch, and which has a short breaking time. The switch includes pressure housings filled with an insulative medium, a plurality of contactors each including a contact, a plurality of operation units actuating the contacts, an insulative spacer dividing the interiors of the pressure housings into the same number of internal spaces as the number of contacts, and an electrode passing completely through the insulative spacer and fastened to the insulative spacer. The contactor is provided one by one for each internal space, and all contacts are electrically connected in series via the electrode, and the operation units actuate the corresponding contacts, respectively.

9 Claims, 6 Drawing Sheets

(51) Int. Cl.
*H01H 33/38* (2006.01)
*H01H 33/14* (2006.01)
*H01H 51/22* (2006.01)
*H01H 33/28* (2006.01)

(52) U.S. Cl.
CPC ..... *H01H 33/666* (2013.01); *H01H 33/6661* (2013.01); *H01H 51/2209* (2013.01); *H01H 33/285* (2013.01)

(58) Field of Classification Search
CPC .. H01H 33/664; H01H 1/0203; H01H 33/008; H01H 33/168; H01H 33/187; H01H 33/34; H01H 33/38; H01H 33/42; H01H 33/6643
See application file for complete search history.

(56) References Cited

U.S. PATENT DOCUMENTS 3,983,345 A * 9/1976 Phillips ..... H01H 33/668 218/122
4,434,333 A * 2/1984 Kawasaki ..... H01H 33/166 218/143
5,719,365 A * 2/1998 Tanimizu ..... H01H 33/022 218/118
6,091,039 A * 7/2000 Pham ..... H02B 13/0356 218/144
6,335,502 B1 * 1/2002 Kikukawa ..... H02B 13/0354 218/10
7,193,172 B2 3/2007 Rokunohe et al.
2002/0056704 A1 * 5/2002 Furuta ..... H02B 5/06 218/13
2005/0056617 A1 3/2005 Rokunohe et al.
2006/0186091 A1 8/2006 Rokunohe et al.
2007/0273461 A1 11/2007 Kang et al.
2008/0007896 A1 * 1/2008 Tsuchiya ..... H02B 11/02 361/612
2013/0284703 A1 * 10/2013 Yoshitomo ..... H01H 33/91 218/84
2015/0042424 A1 2/2015 Maruyama et al.
2015/0083691 A1 * 3/2015 Matsui ..... H01H 33/143 218/3
2015/0084722 A1 * 3/2015 Sugiyama ..... H01H 33/143 335/154

FOREIGN PATENT DOCUMENTS

JP 2004-241204 A 8/2004
JP 2005-94903 A 4/2005
JP 2007-52979 A 3/2007
JP 2007-188734 A 7/2007
JP 2007-523475 A 8/2007
WO WO 2013/161285 A1 10/2013

* cited by examiner

SWITCH

FIELD

Embodiments of the present disclosure relate to a multi-point contact switch that connects or disconnects a plurality of contacts.

BACKGROUND

Switches for a high-voltage which has a role of cutting off a fault current needs to have a performance that is surely capable of cutting off various currents from a small current to a large current. In particular, as for the large current, the following two current cutoff roles must be accomplished.

The one role is to cut off a Short-range Line Fault (SLF) current that has a triangular waveform voltage which has a low absolute value but has a keen change rate, and which appears in the initial stage of rising of a voltage (transient recovery voltage) right after a current zero point. The other role is to cut off a Breaker Terminal short-circuit Fault (BTF) current which has a gentle initial rising of the transient recovery voltage, but which applies a voltage with a high absolute value at a last stage.

In recent years, puffer type switches are widely utilized which have a breaker having connectable and disconnectable contacts, and being placed in a pressure housing filled with an insulative gas like $SF_6$ gas, and which blow the contacts with the insulative gas at the time of a current cutoff operation, thereby extinguishing an arc. According to this scheme, it is necessary to accomplish the two current cutoff roles by a single switch.

Conversely, switches that have breakers which are specialized for the respective current cutoff roles, and which are coupled with each other to accomplish the two current cutoff roles are also developed. That is, those are switches which include a plurality of breakers, and which cause the respective breakers to shear the respective current cutoff roles. According to such switches, the internal space of a pressure housing is separated, a puffer type breaker with an excellent BTF cutoff performance is placed in the one separated space, and a puffer type breaker with an excellent SLF cutoff performance is placed in the other separated space. In addition, both breakers are electrically connected in series.

CITATION LIST

Patent Literatures

Patent Document 1: JP 2003-348721 A

According to the above-explained switches that have breakers which are specialized for the respective current cutoff roles, and which are connected with each other, each breaker has a connectable and disconnectable contact, and a current cutoff operation and a current feeding operation for all contacts are performed by a single operation unit (actuator). Hence, a load to the operation unit is large.

Hence, such an operation unit has a restriction in type and in size, and when an operation energy is not increasable, a breaking time becomes long.

SUMMARY

A switch according to embodiments has been made to address the aforementioned technical problems, and an objective of the present disclosure is to provide a switch which is capable of easily accomplishing a current cutoff role needed for a high-voltage switch, and which has a short breaking time.

In order to accomplish the above objective, a switch according to an embodiment of the present disclosure includes:

a sealed housing filled with an insulative medium;

a plurality of contactors each including a contact;

a plurality of operation units actuating the contacts;

an insulative spacer dividing an interior of the sealed housing into a plurality of internal spaces, a number of the internal spaces being consistent with a number of the contacts; and an electrode passing completely through the insulative spacer, and being fastened to the insulative spacer, in which:

the contactor is provided one by one for each internal space;

all of the contacts are electrically connected in series via the electrode; and each of the operation units actuates the corresponding contact.

DETAILED DESCRIPTION OF EMBODIMENTS

First Embodiment (Entire Structure)

Figure 1:
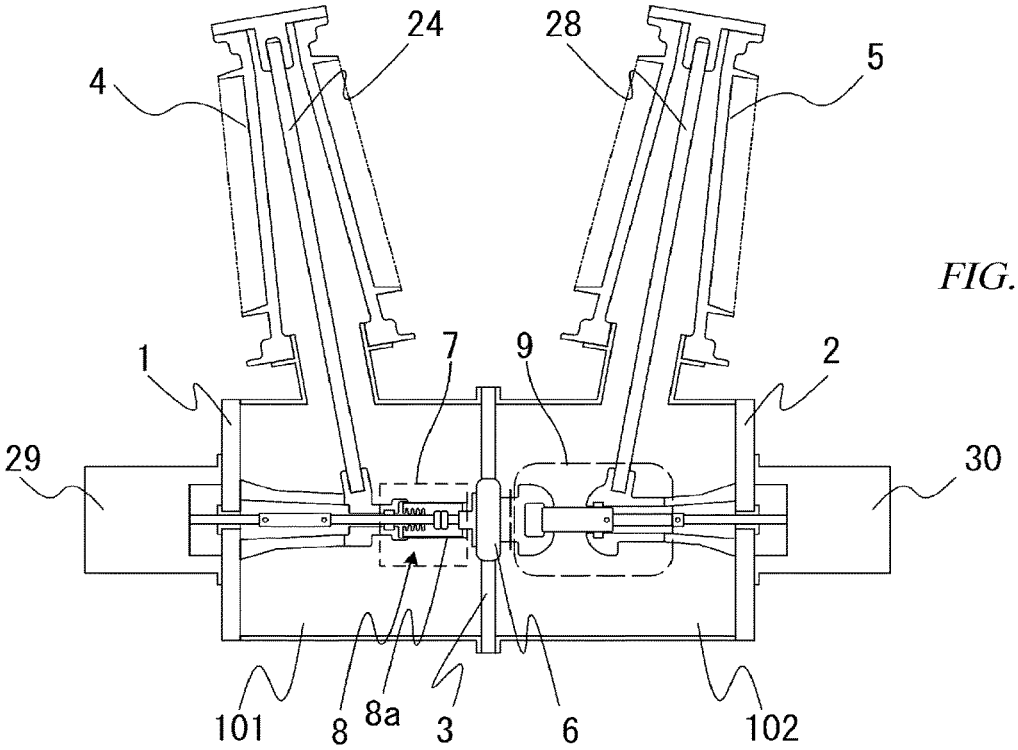
FIG. 1 is a cross-sectional view illustrating an entire structure of a switch according to a first embodiment, and illustrating a current feeding condition.
Figure 2:
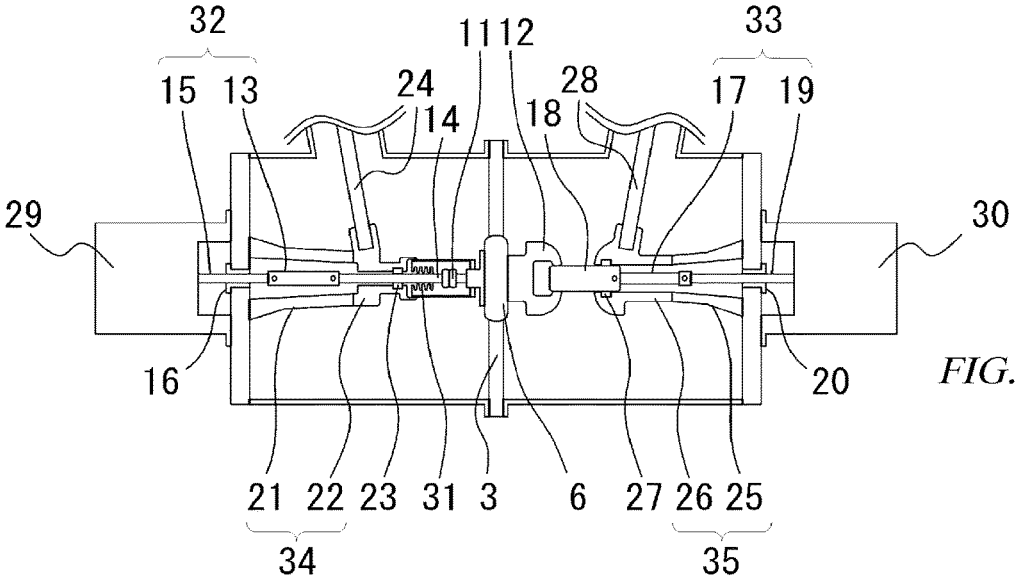
FIG. 2 is a partial enlarged cross-sectional view for FIG. 1.
Figure 3:
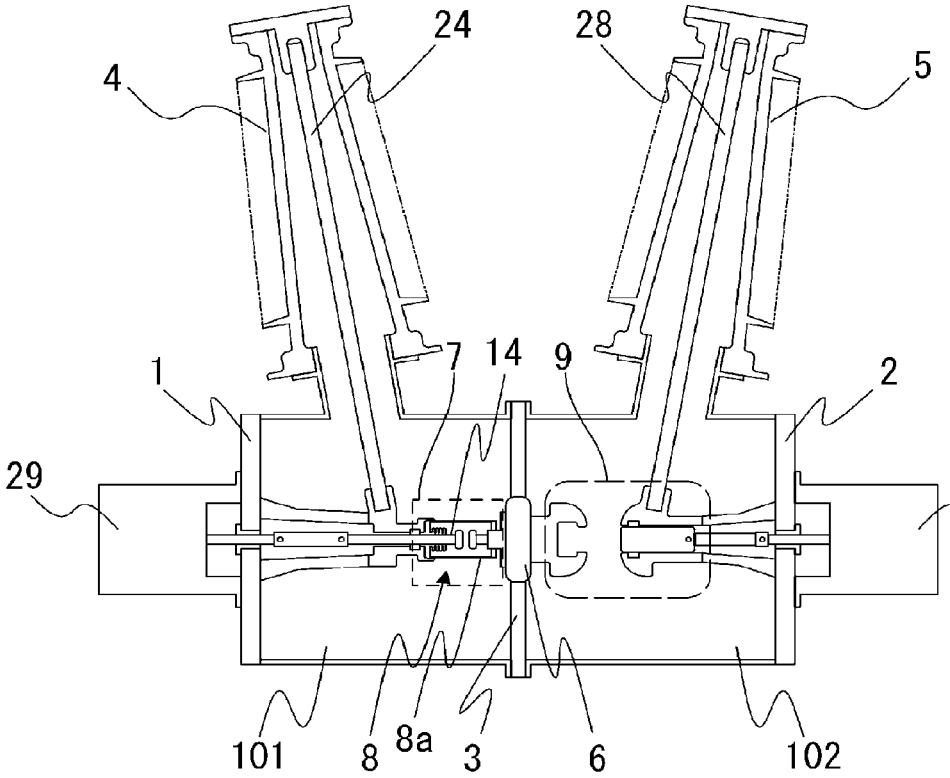
FIG. 3 is a cross-sectional view illustrating an entire structure of the switch according to the first embodiment, and illustrating a current cutoff condition.
Figure 4:
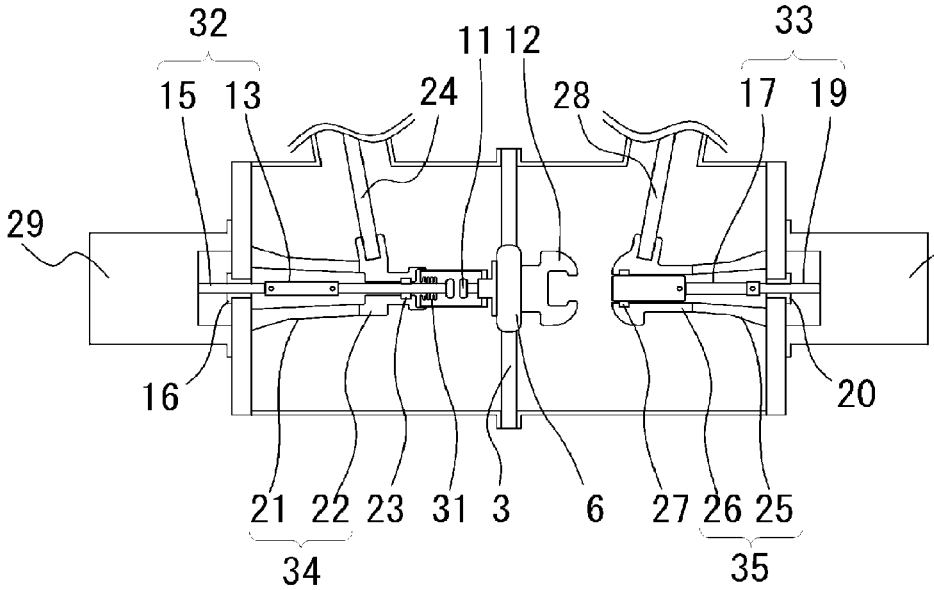
FIG. 4 is a partial enlarged cross-sectional view for FIG. 3.

A structure of a switch according to this embodiment will be explained below with reference to FIGS. 1 to 4. FIGS. 1 and 3 are each a cross-sectional view illustrating an entire structure of the switch of this embodiment, and illustrating a current feeding condition, and a current cutoff condition, respectively. FIGS. 2 and 4 are partial enlarged views of FIGS. 1 and 3, respectively.

The switch of this embodiment includes a plurality of contactors including a plurality of contacts electrically connected in series, and by connecting or disconnecting the contacts, a condition is changed between a current feeding condition and a current cutoff condition. The switch of this embodiment includes pressure housings 1 and 2 formed of a grounded metal or insulator, etc., bushes 4 and 5 connected with the pressure housings 1 and 2, respectively, a plurality of (in this embodiment, two) contactors 7 and 9 including a pair of freely connectable and disconnectable contacts, an insulative spacer 3 that divides the respective interiors of pressure housings 1 and 2 into internal spaces in the same number as that of the contactors, and a stationary electrode 6 which passes completely through the insulative spacer 3, and which is fastened therewith.

The pressure housings 1 and 2 are each a cylindrical housing which has a bottom, and which has an opening formed in the opposite face to the bottom. The opened end is flanged. The pressure housings 1 and 2 form a sealed housing. The pressure housings 1 and 2 holds the insulative spacer 3 between the respective flanges facing with each other, and are fastened in this condition.

The contact of the contactor 7 is placed in the pressure housing 1, while the contact of the contactor 9 is placed in the pressure housing 2. Those contactors are electrically connected in series with the stationary electrode 6 fastened with the insulative spacer 3. In addition, conductors 24 and 28 are disposed in the bushes 4 and 5, respectively, so as to extend to the contactors 7 and 9, respectively. The conductor 24 is electrically connected with the contact of the contactor 7, while the conductor 28 is electrically connected with the contact of the contactor 9.

When the switch is in a current feeding condition, a current is introduced through the bush 4, flows through the conductor 24, the contact of the contactor 7, the stationary electrode 6, the contact of the contactor 9, and the conductor 28 in sequence, and eventually reaches the bush 5. In addition, when the switch is in a current cutoff condition, the respective contacts of the contactors 7 and 9 are released, and thus the current is cut off. An explanation will be given of a detailed structure of the switch according to this embodiment.

(Detailed Structure)

(Internal Spaces 101, 102)

The pressure housing 1, the insulative spacer 3, and the bush 4 form an internal space 101, while the pressure housing 2, the insulative spacer 3, and the bush 5 form an internal space 102. The internal spaces 101 and 102 are in a sealed condition, and in this embodiment, in a fully and hermetically sealed condition. Such internal spaces 101 and 102 are filled with an insulative medium.

An example insulative medium is a sulfur hexafluoride gas ($SF_6$ gas), carbon dioxide, nitrogen, dried air, a combination gas thereof, or an insulative oil. In this embodiment, the $SF_6$ gas is applied. Note that the pressure inside the internal space 101 and the pressure inside the internal space 102 may be different or consistent as needed by, for example, an unillustrated gas supply system, a vacuum pump, etc. In this embodiment, the pressure of the gas in the internal space 101 is lower than or equal to the gas pressure in the internal space 102, and is equal to or higher than an ambient pressure.

(Contactor 7)

The contactor 7 is a vacuum contactor that has an electrode placed in a high-vacuum vacuum housing, and cuts off the current by utilizing the excellent dielectric strength and arc-extinguishing performance of the high vacuum condition. The following explanation is given of a case in which the contactor 7 is the vacuum contactor 7. The vacuum contactor 7 includes a vacuum valve 8 that has a contact. In addition, the vacuum contactor 7 is provided with an operation unit 29 that actuates the contact of the vacuum valve 8, a linkage 32 that transmits actuation force by the operation unit 29 to the contact of the vacuum valve 8, and a supporting unit 34 which has one end connected with the other end of the vacuum valve 8 having one end connected with the stationary electrode 6, and which supports the contact of the vacuum valve 8 in the pressure housing 1.

This vacuum valve 8 has a cylindrical vacuum housing **8*a* with a high-vacuum interior, and this vacuum housing 8*a* is placed in the pressure housing 1. This vacuum housing 8*a* is, for example, an insulator formed of glass or ceramics, etc. A pair of stationary electrode 11 and movable electrode 14 and a bellows 31 that construct the contact are placed in the vacuum housing 8**.

The stationary electrode 11 and the movable electrode 14 are disposed so as to face with each other. The stationary electrode 11 is fastened to the stationary electrode 6 fastened with the insulative spacer 3, and the movable electrode 14 is mechanically connectable and disconnectable relative to the stationary electrode 11. When the movable electrode 14 is released from the stationary electrode 11, an arc is generated between both of the electrodes 11 and 14. The movable electrode 14 has one end facing with the stationary electrode 11, and has the other end passing completely through a wall surface of the vacuum housing **8*a*, and protruding to the exterior. The bellows 31 is stretchable, and maintains the air tightness of the interior of the vacuum housing 8*a* even if the movable electrode 14 is connected or disconnected relative to the stationary electrode 11**.

The linkage 32 includes an insulative rod 13 in a bar shape and formed of an insulative material, and an operation rod 15 in a bar shape and formed of a conductive material. The insulative rod 13 and the operation rod 15 are disposed so as to be coaxial with the stationary electrode 11 and the movable electrode 14. The insulative rod 13 has one end connected with the movable electrode 14, and has the other end which is connected with the operation rod 15, and which extends in the interior of the pressure housing 1. The operation rod 15 passes completely through the wall surface of the pressure housing 1, extends to the exterior thereof, and is connected with the operation unit 29.

The operation unit 29 is disposed outside the pressure housing 1, and actuates the contacts so as to be freely connectable and disconnectable. That is, by the actuation force of the operation unit 29, the operation rod 15 and the insulative rod 13 are pushed and drawn linearly, and thus the movable electrode 14 is freely connectable and disconnectable relative to the stationary electrode 11. Note that the actuation by the operation unit 29 starts based on, for example, an instruction signal output by a control device provided outside the switch.

A sealing member 16 that includes an unillustrated elastic gasket is provided at the wall surface of the pressure housing 1 through which the operation rod 15 passes, and thus the internal space 101 maintains the air tightness even if the operation rod 15 slides against the gasket of the sealing member 16.

The supporting unit 34 has one end fastened to the wall surface of the pressure housing 1 where the sealing member 16 is provided, and has the other end connected with the movable electrode 14. In a broad sense, the supporting unit 34 includes an insulative support 21 which encircles the insulative rod 13, and which extends from the wall surface of the pressure housing 1 where the sealing member 16 is provided toward the insulative spacer 3, and a conductive support 22 which has one end connected with the insulative support 21, and which has the other end connected with the movable electrode 14.

The insulative support 21 and the conductive support 22 are provided coaxially so as not to interfere with the insulative rod 13 and the operation rod 15. A conductive terminal 23 formed of a conductive material is provided between the conductive support 22 and the movable electrode 14, and is electrically connected therewith. Hence, the movable electrode 14 is slidable by the operation unit 29. The vacuum valve 8 has one end of the vacuum housing 8*a* fastened to the stationary electrode 11, and has the other end supported by the supporting unit 34 via the movable electrode 14.

(Contactor 9)

The contactor 9 is capable of employing a puffer type gas breaker or a non-puffer type gas contactor. A puffer type gas breaker includes an electrode that constructs the contact, a puffer cylinder that stores pressure to spray the insulative gas to an arc, and a nozzle that guides the sprayed insulative gas to the arc. In the current cutoff operation or current feeding operation, those components are also moved together with the electrode, and are actuated by the operation unit. Conversely, a non-puffer type gas contactor has no such puffer cylinder and nozzle. The contactor 9 of this embodiment is a non-puffer type gas contactor, has a higher dielectric strength than that of the vacuum contactor 7, and is capable of being actuated at a fast speed. The following explanation will be given of a case in which the contactor 9 is a gas contactor 9. The gas contactor 9 includes a contact. In addition, the gas contactor 9 is provided with an operation unit 30 that actuates the contact of the gas contactor 9, a linkage 33 that transmits actuation force by the operation unit 30 to the contact of the gas contactor 9, and a supporting unit 35 that defines the moving direction of the contact of the gas contactor 9.

The contact of the gas contactor 9 has a larger dielectric strength than that of the contact of the vacuum valve 8 in the vacuum contactor 7, and this contact includes a pair of stationary electrode 12 and movable electrode 18 disposed so as to face with each other in the pressure housing 2. The stationary electrode 12 is fastened to the stationary electrode 6, and the movable electrode 18 is mechanically connectable and disconnectable relative to the stationary electrode 12.

The linkage 33 and the operation unit 30 enable the movable electrode 18 to be mechanically connectable and disconnectable. The linkage 33 includes an insulative rod 17 in a bar shape and formed of an insulative material, and an operation rod 19 in a bar shape and formed of a conductive material. The insulative rod 17 and the operation rod 19 are disposed so as to be coaxial with the stationary electrode 12 and the movable electrode 18. The insulative rod 17 has one end connected with the movable electrode 18, and has the other end connected with the operation rod 19, and extends in the interior of the pressure housing 2. The operation rod 19 passes completely through the wall surface of the pressure housing 2, extends from the insulative rod 17 to the exterior of the pressure housing 2, and is connected with the operation unit 30.

The operation rod 30 is disposed outside the pressure housing 2, and actuates the contact so as to be freely connectable and disconnectable. That is, by the actuation force of the operation unit 30, the operation rod 19 and the insulative rod 17 are pushed and drawn linearly, and thus the movable electrode 18 is freely connectable and disconnectable relative to the stationary electrode 12. Note that the actuation by the operation unit 30 starts based on, for example, an instruction signal output by a control device provided outside the switch.

A sealing member 20 that includes an unillustrated elastic gasket is provided at the wall surface of the pressure housing 1 through which the operation rod 19 passes, and thus the internal space 102 maintains the air tightness even if the operation rod 19 slides against the gasket of the sealing member 20.

The supporting unit 35 has one end fastened to the wall surface of the pressure housing 2 where the sealing member 20 is provided, and has the other end connected with the movable electrode 18. In a broad sense, the supporting unit 35 includes an insulative support 25 which encircles the insulative rod 17, and which extends from the wall surface of the pressure housing 2 where the sealing member 20 is provided toward the insulative spacer 3, and a conductive support 26 which has one end connected with the insulative support 25, and which has the other end connected with the movable electrode 18.

The insulative support 25 and the conductive support 26 are coaxially provided so as not to contact the insulative rod 17 and the operation rod 19. A conductive terminal 27 formed of a conductive material is provided between the conductive support 26 and the movable electrode 18 and is electrically connected therewith. Hence, the movable electrode 18 is slidable by the operation unit 30.

(Current Feeding Condition)

When the switch employing the above explained structure is in a current feeding condition according to this embodiment, the current introduced from the bush 4 flows through the conductor 24, the conductive support 22, the conductive terminal 23, the movable electrode 14, the stationary electrode 11, the stationary electrode 6, the stationary electrode 12, the movable electrode 18, the conductive terminal 27, the conductive support 26 and the conductor 28 in sequence, and reaches the bush 5.

(Current Cutoff Operation)

Conversely, when a current cutoff instruction signal is given to the operation units 29 and 30 from the exterior of the switch, by the actuation forces from the operation units 29 and 30 to release the movable electrodes 14 and 18 from the stationary electrodes 11 and 12, respectively, the movable electrodes 14 and 18 are simultaneously released from the stationary electrodes 11 and 12, respectively, and a current cutoff operation starts. More specifically, the movable electrode 14 of the vacuum valve 8 is released from the stationary electrode 11. In this operation, an arc formed by evaporated particles and electrons from the electrodes is generated between the stationary electrode 11 and the movable electrode 14, but since the interior of the vacuum housing 8*a* is in a high-vacuum condition, such substances forming the arc are diffused, and are unable to maintain the shape, and thus the arc is extinguished. Hence, the flowing current is cut off. In addition, in the gas contactor 9, the movable electrode 18 is released from the stationary electrode 12, and an arc is generated between both electrodes 12 and 18, but since an insulation distance is ensured between both electrodes 12 and 18, this arc is also extinguished.

In this current cutoff operation, a separation gas that is the $SF_6$ gas is produced by the arc in the internal space 102. This separation gas has an action of corroding the surface layer of the vacuum housing 8*a* of the vacuum valve 8 formed of an insulator, but since the vacuum housing 8*a* is placed in the fully sealed internal space 101, a corrosion by the separation gas produced in the internal space 102 does not occur.

Note that the vacuum valve 8 includes the bellows 31 that does not have an excellent high-pressure resistance, but the gas pressure in the internal space 101 is set to be equal to or lower than the gas pressure in the internal space 102 and is equal to or higher than an ambient pressure which is the pressure that the bellows 31 is capable of withstanding. Hence, the bellows 31 in the internal space 101 is protected while the dielectric strength at the contact in the internal space 101 is ensured.

As explained above, in the current cutoff operation, the vacuum contactor 7 bears an SLF cutoff role for a keen transient recovery voltage, and the gas contactor 9 that has a high dielectric strength bears a BTF cutoff role for a high transient recovery voltage. Hence, both types of current cutoff roles are easily accomplished.

(Effect)

(1) The switch according to this embodiment includes the operation units that actuate the respective contacts of the plurality of contactors. Hence, a load per an operation unit is little, and thus the contact is releasable at a fast speed.

(2) The contactors 7 and 9 are provided with the linkages 32 and 33, respectively, which transmit actuation forces to the contacts from the operation units 29 and 30. In addition, the operation units 29 and 30 are disposed outside the pressure housings 1 and 2, respectively, and the linkages 32 and 33 pass through the respective pressure housings 1 and 2 while maintaining the air tightness of the interiors thereof, and are connected with the operation units 29 and 30, respectively. Hence, the operation units 29 and 30 do not directly contact the separation gas that is the $SF_6$ gas produced by arcs in the current cutoff operation, thereby suppressing a corrosion action to the operation units 29 and 30 by this separation gas. In addition, the operation units 29 and 30 are disposed outside the pressure housings 1 and 2, and thus the easiness of maintenance for the operating units 29 and 30 is improved.

(3) In the plurality of contactors, at least one contactor is realized by the vacuum contactor 7 that includes a vacuum valve with a contact, and at least the other contactor is realized by the gas contactor 9 with a contact that has a larger dielectric strength than that of the contact of the vacuum valve 8. According to this structure, in the current cutoff operation, the vacuum contactor 7 bears the SLF cutoff role for a keen transient recovery voltage, and the gas contactor 9 bears the BTF role for a high transient recovery voltage. Hence, both types of current cutoff roles are easily accomplished. As explained above, by employing at least one vacuum contactor 7 and at least one gas contactor 9, the respective contactors bear and accomplish the SLF cutoff role and the BTF cutoff role.

(4) In addition, the vacuum valve 8 of the vacuum contactor 7 includes the contact-sensitive contact, and the movable electrode 14 has a little weight, and thus the current cutoff operation can be completed within a quite short time. In addition, the gas contactor 9 includes a dedicated operation unit for a puffer type gas contactor, and thus a load per an operation unit in the whole switch is reduced, and thus the contact is releasable at a fast speed. Still further, the gas contactor 9 of this embodiment has no puffer cylinder and nozzle for the movable electrode 18, and thus the weight of the moving component to be actuated by the operation unit 30 is little in comparison with that of a puffer type contactor. This enables the operation unit 30 to actuate the movable electrode 18 at a further faster speed, and thus a necessary time for ensuring the insulation distance is remarkably reduced. As explained above, the switch of this embodiment is capable of cutting off the current and ensuring the insulation distance within a shorter time than conventional switches that include a plurality of puffer type contacts. Therefore, a breaking time is reduced.

(5) The switch of this embodiment employs a structure in which the internal space 101 and the internal space 102 are fully sealed, and thus the respective internal spaces may have different pressures. More specifically, the gas pressure in the internal space 101 is set to be equal to or lower than the gas pressure in the internal space 102, and is equal to or higher than the ambient pressure. Hence, the bellows 31 in the internal space 101 is protected while the dielectric strength of the contact in the internal space 102 is ensured.

Second Embodiment (Structure)

Figure 5:
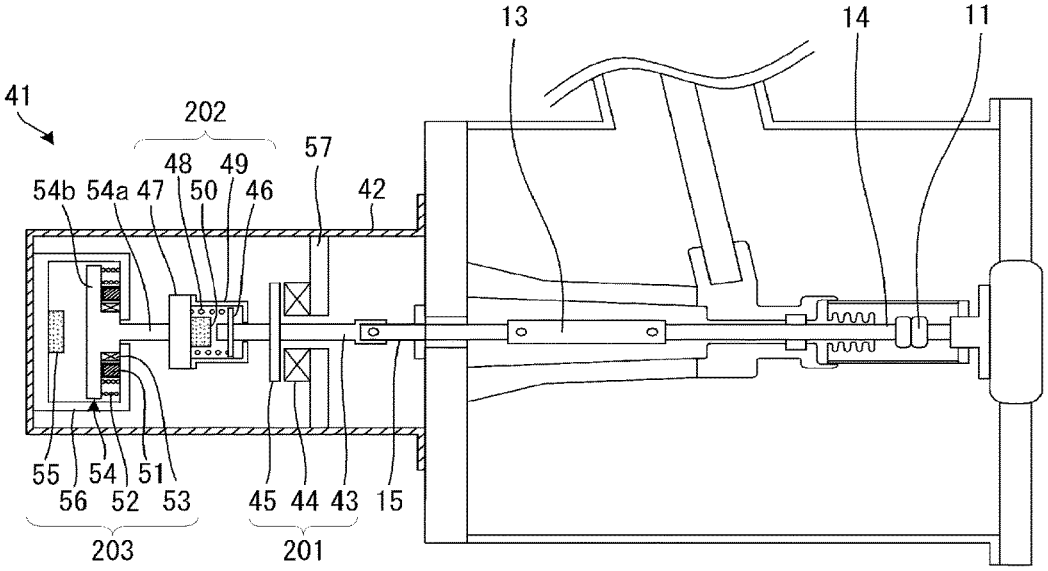
FIG. 5 is a cross-sectional view illustrating an entire structure of a vacuum contactor of a switch according to a second embodiment, and illustrating a current feeding condition.
Figure 6:
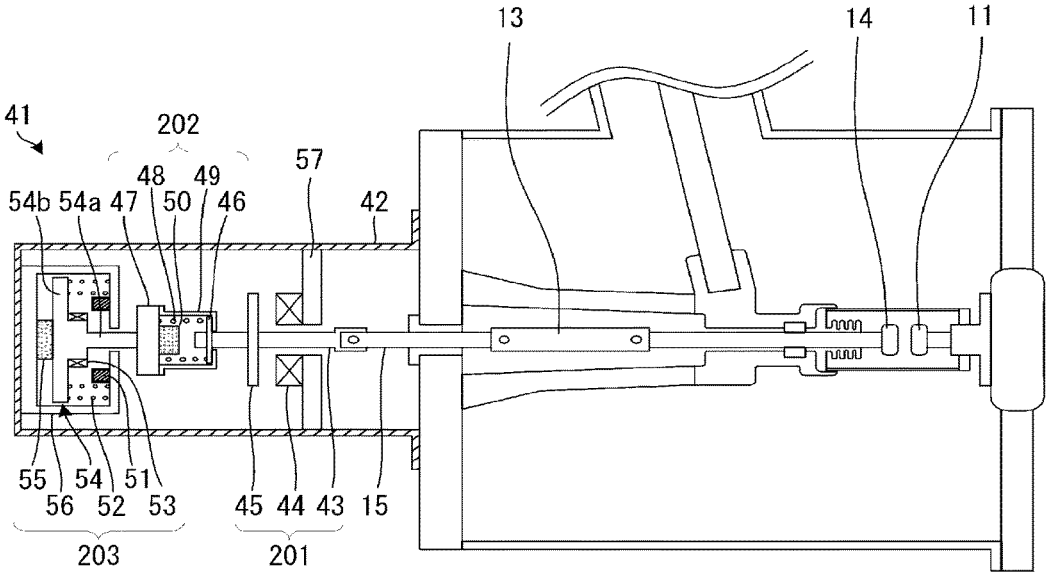
FIG. 6 is a cross-sectional view illustrating an entire structure of the vacuum contactor of the switch according to the second embodiment, and illustrating a current cutoff condition.

An explanation will be given of a second embodiment with reference to FIGS. 5 and 6. FIGS. 5 and 6 are enlarged cross-sectional views of a vacuum contactor 7 according to the second embodiment. FIG. 5 illustrates a current feeding condition of the vacuum contactor 7, while FIG. 6 illustrates a current cutoff condition of the vacuum contactor 7. The second embodiment employs the same basic structure as that of the first embodiment. Only the difference from the first embodiment will be explained below, and the same component as that of the first embodiment will be denoted by the same reference numeral, and, the detailed explanation thereof will be omitted.

A switch of the second embodiment includes, as the operation unit for the vacuum contactor 7, an electromagnetic repulsive operation unit 41. The electromagnetic repulsive operation unit 41 utilizes electromagnetic repulsion force, and has a high responsiveness in a contact open operation. This electromagnetic repulsive operation unit 41 includes a mechanism box 42, a fast-speed contact open unit 201, a wiping mechanism 202, and a holding mechanism 203.

The mechanism box 42 is a hollow box which has an end face opened, and has this opened face fastened and connected with the wall surface of the pressure housing 1 where the sealing member 16 is provided, and respective components that are the fast-speed contact open unit 201, the wiping mechanism 202, and the holding mechanism 203 are placed in this mechanism box 42.

The fast-speed contact open unit 201 includes a movable shaft 43, an electromagnetic repulsive coil 44, and a repulsive ring 45. The movable shaft 43 is a bar member that is connected with the operation rod 15. The repulsive ring 45 is an annular component formed of a conductor, and is fitted in the opening of this annular ring. In addition, the repulsive ring is fastened around the outer circumference of the movable shaft 43. A supporting member 57 is fastened to the internal wall of the mechanism box 42, and extends toward the movable shaft 43. The electromagnetic repulsive coil 44 is formed of a conductor, and is disposed on the supporting member 57 so as to face the repulsive ring 45. The electromagnetic repulsive coil 44 is connected with an unillustrated coil exciter, and a current is supplied to the electromagnetic repulsive coil 44 from a capacitor of this coil exciter. This current excites the electromagnetic repulsive coil 44, and such a coil applies electromagnetic repulsion force to the repulsive ring 45, thereby actuating the movable shaft 43. Note that example conductors for the electromagnetic coil 44 and the repulsive ring 45 are copper, silver, gold, aluminum, and iron.

The wiping mechanism 202 transmits the electromagnetic repulsion force from the fast-speed contact open unit 201 to the holding mechanism 203. This wiping mechanism 202 includes a flange 46 engaged with and attached to the movable shaft 43, a coupler 47 formed of an insulative material, a wiping spring 48 disposed between the flange 46 and the coupler 47, a flange holder 49 that holds the flange 46, and a shock absorber 50 that reduces shock when the movable shaft 43 collides.

The coupler 47 is, for example, a flat plate, and is disposed so as to face the flange 46. The wiping spring 48 has one end connected with the flange 46, and has the other end connected with the coupler 47 so as to apply spring force to both the flange 46 and the coupler 47. The flange holder 49 is a cylindrical member with a bottom. The flange holder 49 is fastened to the coupler 47 so as to encircle the flange 46 and the wiping spring 48, and has the bottom that serves as a stopper for the flange 46. Note that an opening is formed in the bottom of the flange holder 49, and thus the movable shaft 43 is movable through this opening. The shock absorber 50 is fastened to the coupler 47, and absorbs collision shock from the movable shaft 43.

The holding mechanism 203 includes a permanent magnet 51, an open-circuit spring 52, an electromagnetic solenoid 53, a movable component 54, a shock absorber 55, and a holding mechanism box 56. The holding mechanism box 56 is fastened to the internal surface of the mechanism box 42, and the permanent magnet 51, the open-circuit spring 52, the electromagnetic solenoid 53, the movable component 54, and the shock absorber 55 are placed in the holding mechanism box 56.

The movable component 54 is formed of a magnetic substance on which attractive force by the permanent magnet 51 acts. The movable component 54 is formed in a substantially T shape, has a protruding portion 54*a* which extends toward the movable shaft 43 through the opening of the holding mechanism box 56, and which is fastened to the coupler 47. The permanent magnet 51 is fastened to the internal surface of the holding mechanism box 56 at the movable-shaft-43 side, and faces both hands 54*b* of the movable component 54. The movable component 54 is attracted and pulled by the permanent magnet 51. The permanent magnet 51, the electromagnetic solenoid 53, and the movable component 54 generate thrust force in a direction in which the movable electrode 14 that constructs the contact of the vacuum valve 8 is closed.

The open-circuit spring 52 is disposed between the both hands 54*b* of the movable component 54 and a wall surface of the holding mechanism box 56 where the permanent magnet 51 is provided so as to apply spring force to the movable component 54. Note that as for the open-circuit spring 52, a spring which has the spring force larger than a sum of the self-closing force of the vacuum valve 8 and the attractive force of the permanent magnet 51 in an open circuit condition, but smaller than the attractive force of the permanent magnet 51 to the movable component 54 in the closed circuit condition.

The electromagnetic solenoid 53 is a winding formed of a conductive material, and is wound around and fastened to the basal end of a protruding portion 54*a* of the movable component 54. The electromagnetic solenoid 53 is connected with an unillustrated external power supply, and when the external power supply supplies a current, the electromagnetic solenoid 53 is excited. The shock absorber 55 is fastened to the internal surface of the holding mechanism box 56 which faces with the opening of the holding mechanism box 56.

(Current Cutoff Operation)

An explanation will be given of a contact open operation of the electromagnetic repulsive operation unit 41 in the current cutoff operation of the switch according to this embodiment. First, in a closed circuit condition in which the stationary electrode 11 of the vacuum valve 8 and the movable electrode 14 are in contact with each other, when a contact open instruction is given to the coil exciter from the exterior of the switch, a current is supplied to the electromagnetic repulsive coil 44 from the capacitor of the coil exciter, and thus the electromagnetic repulsive coil 44 is excited. Hence, electromagnetic repulsion force is applied to the repulsive ring 45, and thus the movable electrode 14 performs a contact open operation and moves in a direction from the stationary electrode 11 toward the electromagnetic repulsive operation unit 41 (hereinafter, referred to as an open-circuit direction, and the opposite direction thereto is referred to as a closed-circuit direction in the case of vacuum contactor 7) at a fast speed via the movable shaft 43 and the linkage 32.

The movable shaft 43 moves in the open-circuit direction, the flange 46 compresses the wiping spring 48, and collides the shock absorber 50. At this time, the movable shaft 43 has a bounce in the closed-circuit direction reduced by the shock absorber 50, and pushes the coupler 47 in the open-circuit direction via the wiping spring 48 and the shock absorber 50.

Conversely, a current is supplied to the electromagnetic solenoid 53 of the holding mechanism 203 from the external power supply prior to a timing at which the movable shaft 43 pushes the coupler 47 in the open-circuit direction. Hence, the electromagnetic solenoid 53 is excited in a direction in which the magnetic fluxes of the permanent magnet 51 are canceled, and thus the attractive force by the permanent magnet 51 to the movable component 54 decreases. Accordingly, the movable component 54 is actuated in the open-circuit direction by the spring force from the open-circuit spring 52.

In addition, by the flange holder 49 that abuts the flange 46 via the coupler 47, the movable component 54 pulls the coupler 47, the flange holder 49, and the flange 46 integrally, and the movable electrode 14 is further opened via the movable shaft 43. Subsequently, by the inertial force of the movable shaft 43 and the spring force of the open-circuit spring 52, the movable electrode 14 is opened until a predetermine gap is accomplished, and the movable component 54 collides the shock absorber 55. This shock is absorbed by the shock absorber 55, and the movable component 54 stops. Note that the term predetermined gap is a clearance between the contact of the stationary electrode 11 and the contact of the movable electrode 14 necessary to cut off the current.

After the clearance between the movable electrode 14 and the stationary electrode 11 becomes the predetermined gap, a current supply to the electromagnetic repulsive coil 44 and the electromagnetic solenoid 53 is suspended, thereby terminating the excitation operations thereof. For example, a capacitor that has stored electrical charges may be utilized as the external power supply, the stored electrical charges may be released, and the excitation condition may be canceled in accordance with a completion of the electrical charge release. After this operation, since the spring force by the open-circuit spring 52 is larger than the sum of the self-closing force by the vacuum valve 8 and the attractive force by the permanent magnet 51, the contact of the vacuum valve 8 still maintains the open-circuit condition.

(Current Feeding Condition)

In the current feeding condition illustrated in FIG. 5, the stationary electrode 11 of the vacuum valve 8 and the movable electrode 14 thereof are in contact with each other with a predetermined load. The attractive force to the movable component 54 by the permanent magnet 51 is larger than the open-circuit force accomplished by the wiping spring 48 and the open-circuit spring 52. Hence, by the attractive force of the permanent magnet 51, the movable component 54 has the both hands 54*b* that compress the open-circuit spring 52, abut the permanent magnet 51, and thus the movable component 54 becomes a condition fastened to the permanent magnet 51. Conversely, by this attractive force, the movable electrode 14 abuts the stationary electrode 11 via the moving shaft 43, and the spring force by the wiping spring 48 is applied. As explained above, the stationary electrode 11 of the vacuum valve 8 and the movable electrode 14 thereof are in contact with each other by the load from the wiping spring 48, and the attractive force of the permanent magnet 51 to the movable component 54 maintains the current feeding condition (closed-circuit condition).

(Effect)

The switch according to this embodiment is capable of accomplishing the following effects in addition to the same effects as the first embodiment. In this embodiment, the operation unit for the vacuum contactor 7 is the electromagnetic repulsive operation unit 41. The vacuum contactor 7 has a short stroke that is a moving distance of the contact of the movable electrode 14 necessary to cut off the current, and the weight of the moving component is light. Hence, a high responsiveness in the contact open operation is accomplished, and thus the breaking time is further reduced.

In particular, according to this embodiment, the electromagnetic repulsive operation unit 41 includes the fast-speed contact open unit 201 which includes the electromagnetic repulsive coil 44, the supporting member 57 that supports the electromagnetic repulsive coil 44, and the repulsive ring 45 disposed so as to face the electromagnetic repulsive coil 44. Accordingly, by the electromagnetic repulsive force acting between the excited electromagnetic repulsive coil 44 and the repulsive ring 45, the electromagnetic repulsive operation unit 41 that performs a contact open operation has rising of actuation force quite faster than that of the operation unit which utilizes spring force and hydraulic pressure as an actuation source, thereby accomplishing a remarkably high responsiveness. Hence, the SLF cutoff performance for the keen transient recovery voltage is excellent.

In addition, the electromagnetic repulsive operation unit 41 is provided with thrust force generator that applies thrust force to the contact of the vacuum valve 8. More specifically, the movable component 54 which is indirectly connected with the movable shaft 43 via the coupler 47, the flange holder 49, the flange 46, etc., and which is formed of a magnetic material, the permanent magnet 51, and, the electromagnetic solenoid 53 are provided. Accordingly, since the attractive force by the permanent magnet 51 and by the electromagnetic solenoid 53 acts on the movable component 54, thrust force in the closed-circuit direction is generated and acts on, in particular, the movable component 54 and the movable shaft 43. Hence, the movable electrode 14 is actuated so as to contact the stationary electrode 11.

Third Embodiment (Structure)

An explanation will be given of a third embodiment with reference to FIG. 7 and FIG. 8. The third embodiment employs the same basic structure as that of the first embodiment. Only the difference from the first embodiment will be explained below, and the same component as that of the first embodiment will be denoted by the same reference numeral, and, the detailed explanation thereof will be omitted.

A switch according to the third embodiment employs a linear operation unit as the operation unit for the gas contactor 9. FIGS. 7 and 8 are each a cross-sectional view of the linear operation unit according to the third embodiment, and FIG. 7 illustrates a current feeding condition of the gas contactor 9, while FIG. 8 illustrates a current cutoff condition of the gas contactor 9.

The linear operation unit 61 utilizes a magnetic force mutual action, and has a high responsiveness in the contact open operation. This linear operation unit 61 includes a mechanism box 62 which has one end surface opened, and the opened surface is fastened and connected with the wall surface of the pressure housing 2 where the sealing member 20 is provided, a linear electric motor 63 placed in the mechanism box 62, and a fastening member 64 that fastens the linear electric motor 63 to the internal surface of the mechanism box 62.

The linear electric motor 63 includes a cylindrical stator 65 fastened to the fastening member 64, and a cylindrical movable component 66 which is located at the opposite side to the fastening member 64, and which is movable in the axial direction of the stator 65. The stator 65 includes an external sleeve 65*a* and an internal sleeve 65*b* both constructing a coaxial double-shell structure. A predetermined clearance is provided between the external sleeve 65*a* and the internal sleeve 65*b*. The movable component 66 has a diameter which is larger than the diameter of the internal sleeve 65*b*, but which is smaller than the diameter of the external sleeve 65*a*, and is movable in the axial direction and in a space between the external sleeve 65*a* and the internal sleeve 65*b*. The movable component 66 is connected with the operation rod 19, and actuation force by the movable component 66 is transmitted to the operation rod 19.

Figure 7:
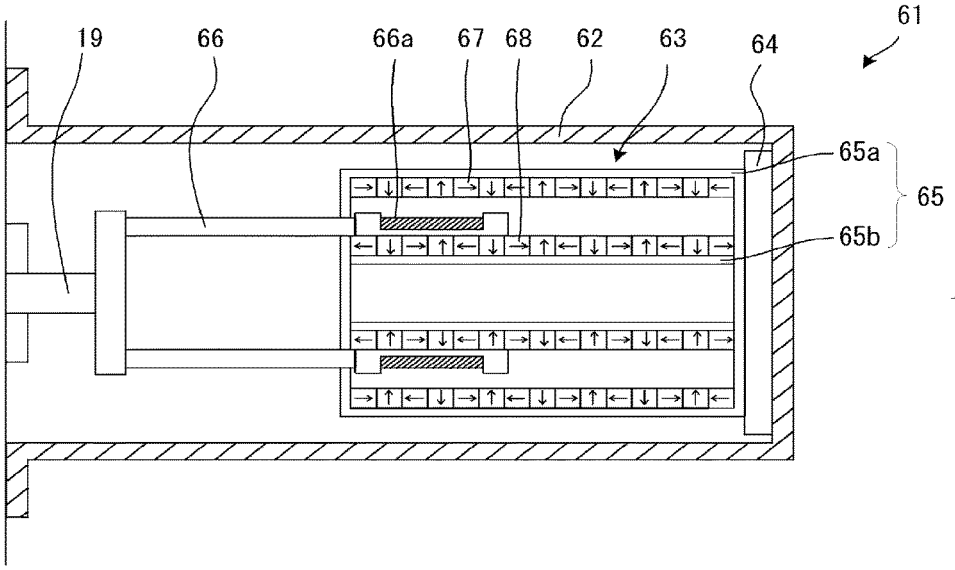
FIG. 7 is a cross-sectional view of an operation unit of a gas contactor according to a third embodiment, and illustrating a current feeding condition.
Figure 8:
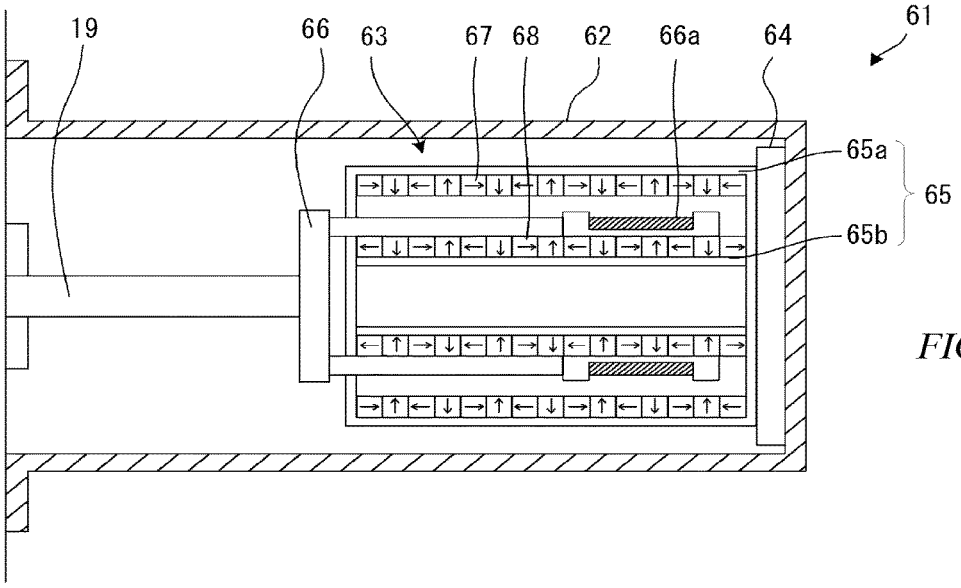
FIG. 8 is a cross-sectional view of the operation unit of the gas contactor according to the third embodiment, and illustrating a current cutoff condition.

As illustrated in FIGS. 7 and 8, the linear electric motor 63 employing the above-explained shell structure moves forward and backward the movable component 66 around which a three-phase coil 66*a* is wound in the axial direction by magnetic fields produced by a row of external permanent magnets 67 and a row of internal permanent magnets 68 which have substantially equal magnetization energies, and, by excitation of the three-phase coil 66*a*. This actuation operation becomes thrust force in a linear direction.

That is, in the interior of the linear electric motor 63, the three-phase coil 66*a* is wound around the movable component 66. The location where such a coil is wound is recessed by what corresponds to a step so as to maintain a sufficient strength without passing completely through the outer circumference of the movable component. Hence, the three-phase coil 66*a* is flat relative to the outer circumference of the movable component 66*a* or is embedded therein. The three-phase coil 66*a* is connected with an actuation device (unillustrated) that supplies an excitation current which is power supplied from the external power supply (unillustrated).

The row of external permanent magnets 67 and the row of internal permanent magnets 68 are arranged and laid out along the axial direction across the shell wall that forms the movable component 66. A predetermined clearance is provided between the shell wall of the movable component 66, and, the row of external permanent magnets 67 and the row of internal permanent magnets 68.

The internal permanent magnet 68 is formed in a circular arc shape or an annular shape, and is fastened to the internal sleeve 65*b*. The internal permanent magnet 68 is fitted in the outer circumference of the internal sleeve 65*b*, and the plurality of internal permanent magnets is arranged side by side in the axial direction of the internal sleeve 65*b*, thus facing the inner circumference of the movable component 66.

The external permanent magnet 67 is formed in a circular arc shape or an annular shape, and is fastened to the external sleeve 65*a*. The external permanent magnet 67 is fitted in the inner circumference of the external sleeve 65*a*, and the plurality of external permanent magnets is arranged side by side in the axial direction of the external sleeve 65*a*, thereby facing the outer circumference of the movable component 66.

The internal permanent magnets 68 and the external permanent magnets 67 are arranged side by side in a Halbach array, respectively, which change respective magnetized directions little by little. In this embodiment, the permanent magnets are disposed in such a way that the magnetization directions of the adjoining permanent magnets are turned by 90 degrees by 90 degrees at a maximum on a cross-section that includes the center axis of the movable component 66.

In addition, the row of internal permanent magnets 68 and the row of external permanent magnets 67 have opposite magnetization directions to be turned. That is, when, for example, the magnetization direction as viewed along the row of the external permanent magnets 67 in sequence is turned in the clockwise direction, and when viewed along the row of internal permanent magnets 68 in sequence, the magnetization direction is turned in the counterclockwise direction.

Still further, the internal permanent magnet 68 and the external permanent magnet 67 are disposed so as to face with each other one by one across the shell wall of the movable component 66. The internal permanent magnet 68 and the external permanent magnet 67 that have respective radial-direction components with magnetization vectors in the same direction face with each other, and the internal permanent magnet 68 and the external permanent magnet 67 that have respective axial-direction components with the magnetization vectors in the opposite directions face with each other. The radial direction and the axial direction are directions defined with reference to the external permanent magnet 67 and the internal permanent magnet 68 formed in the circular arc or annular shape.

(Current Cutoff Operation)

An explanation will be given of the contact open operation by the linear operation unit 61 in the current cutoff operation of the switch according to this embodiment. First, when a contact open instruction is given to an actuation device from the exterior of the switch, an excitation current is supplied to the three-phase coil 66*a*, and the three-phase coil 66*a* is excited. Hence, a magnetic field is generated. Conversely, since the external permanent magnets 67 and the internal permanent magnets 68 have substantially equal magnetization energies, a quite large number of magnetic fluxes in the radial direction is distributed in the clearance between the row of the external permanent magnet 67 and the row of the internal permanent magnet 68. Since the three-phase coil 66*a* is disposed in this clearance, most magnetic fluxes are interlinked with the three-phase coil 66*a* at a right angle.

Hence, large thrust force is generated by magnetic force mutual action, and the movable component 66 around which the three-phase coil 66*a* is wound performs a contact open operation at a fast speed in a direction from the operation rod 19 toward the fastener member 64 (hereinafter, in the case of gas contactor 9, referred to as an open-circuit direction. In addition, the opposite direction thereto is referred to as a closed-circuit direction). When the operation rod 19 is moved backward by the movement of the movable component 66 in the open-circuit direction, the movable contact of the movable electrode 18 starts moving apart from the stationary contact of the stationary electrode 12, an arc is extinguished after a current zero point has elapsed, thus accomplishing a current cutoff.

The actuation device supplies an excitation current at a timing reaching a current cutoff, i.e., so as to have the predetermined gap in the clearance between the movable contact of the movable electrode 18 and the stationary contact of the stationary electrode 12. When the predetermined gap is accomplished and the movable component 66 and the movable electrode 18 stop, the actuation device is deactivated, thereby allowing the thrust force acting on the movable component to be zero. Hence, the open-circuit condition of the gas contactor 9 is maintained.

(Effect)

The switch according to this embodiment accomplishes the following effects in addition to the same effects as those of the first embodiment. In this embodiment, the operation unit of the gas contactor 9 is the linear operation unit 61. This linear operation unit 61 has intermediate characteristics between the operation unit that has spring force and hydraulic pressure as an actuation source, and the electromagnetic repulsive operation unit 41 of the second embodiment that has electromagnetic repulsive force as an actuation source. That is, the rising of actuation force is slightly less than that of the electromagnetic repulsive operation unit 41, but is sufficiently high in comparison with the operation unit that has spring force and hydraulic pressure as an actuation source.

In addition, in comparison with the electromagnetic repulsive operation unit 41, it is easy to increase the capacity of actuation energy by, for example, applying the external permanent magnet 67 and the internal permanent magnet 68 which have larger magnetization energy, increasing the number of those magnets, and increasing the number of turns of the three-phase coil 66*a*.

Hence, the linear operation unit 61 of this embodiment is a suitable operation unit when a relatively long stroke and a high responsiveness are required for a contactor. Since the gas contactor 9 needs to have such performance, when the linear operation unit 61 of this embodiment is applied to the gas contactor 9, the switch which accomplishes a high responsiveness in the contact open operation, and which is capable of reducing the breaking time is obtained.

Fourth Embodiment (Structure)

A fourth embodiment will be explained with reference to FIG. 9. The fourth embodiment employs the same basic structure as that of the first embodiment. Only the difference from the first embodiment will be explained below, and the same component as that of the first embodiment will be denoted by the same reference numeral, and, the detailed explanation thereof will be omitted.

Figure 9:
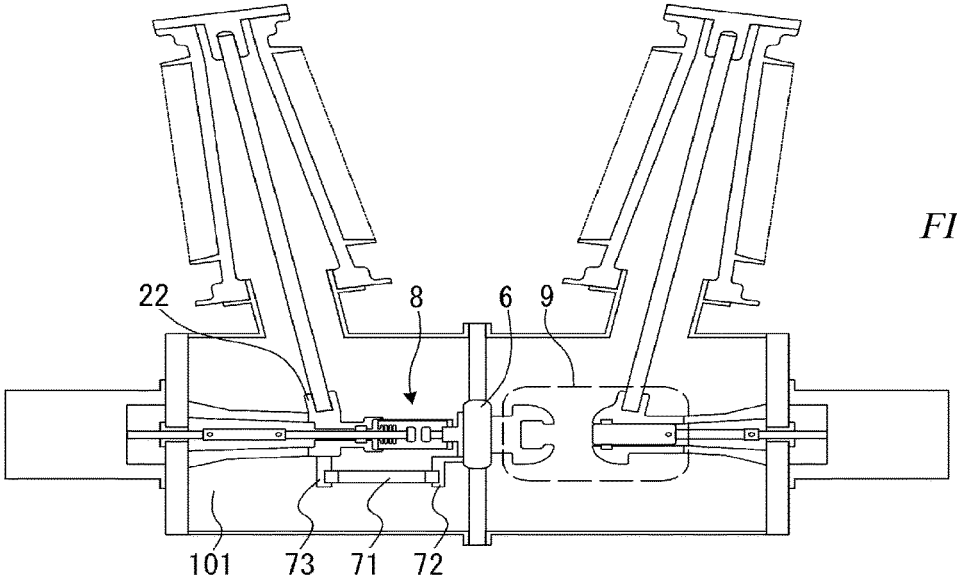
FIG. 9 is a cross-sectional view illustrating a current cutoff condition of a switch according to a fourth embodiment.

FIG. 9 is a cross-sectional view illustrating an entire structure of a switch according to the fourth embodiment. In this embodiment, as illustrated in FIG. 9, a capacitor 71 is placed in the internal space 101, and this capacitor 71 is electrically connected in parallel with the vacuum valve 8 between a conductive parallel member 72 connected with the stationary electrode 6, and a conductive parallel member 73 connected with the conductive support 22.

(Action and Effect)

In the current cutoff condition of the switch according to the first embodiment, after a fault current is cut off, a half of the transient recovery voltage applied to the switch is applied to the respective contacts of the vacuum valve 8 and the gas contactor 9. Since the dielectric strength value of the vacuum valve 8 is lower than that of the contact of the gas contactor 9, a dielectric breakdown occurs at a lower voltage than that of this contact, and the dielectric strength performance of the switch is determined based on the voltage value at this time. Conversely, according to this embodiment, since the capacitor 71 is connected in parallel with the vacuum valve 8, a voltage to be applied to the vacuum valve 8 becomes smaller than that of the contact of the gas contactor 9, and thus the dielectric strength performance of the switch is improved.

The capacitance of this capacitor 71 is determined in consideration of the respective parasitic capacitance of the contacts of the vacuum valve 8 and the gas contactor 9, and the respective dielectric strengths of the vacuum valve 8 and the gas contactor 9. That is, when a dielectric strength value of the contact of the vacuum valve 8 is A, a dielectric strength value of the contact of the gas contactor 9 is B, a parasitic capacitance of the contact of the vacuum valve 8 is a, a parasitic capacitance of the contact of the gas contactor 9 is b, and the capacitance of the capacitor 71 is c, the capacitance c of the capacitor 71 is defined as $c=(B/A)b-a$. By designing the capacitance of the capacitor, a ratio of the dielectric strength value between the vacuum valve 8 and the contact of the gas contact 9, and, a voltage division ratio between the contact of the vacuum valve 8 and the contact of the gas contactor 9 become equal. Hence, a dielectric strength value V of the switch is improved up to $V=A+B$.

As explained above, according to this embodiment, a switch that has a high dielectric strength performance is obtainable.

Fifth Embodiment (Structure)

A fifth embodiment will be explained with reference to FIG. 10. The fifth embodiment employs the same basic structure as that of the fourth embodiment. Only the difference from the fourth embodiment will be explained below, and the same component as that of the first embodiment will be denoted by the same reference numeral, and, the detailed explanation thereof will be omitted.

Figure 10:
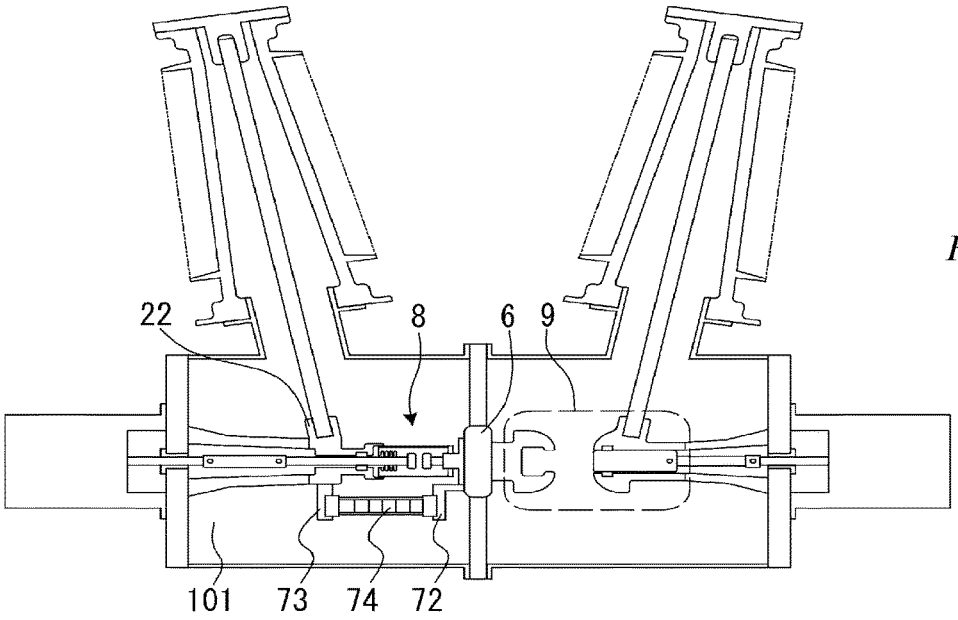
FIG. 10 is a cross-sectional view illustrating a current cutoff condition of a switch according to a fifth embodiment.

FIG. 10 is a cross-sectional view illustrating an entire structure of a switch according to the fifth embodiment. In this embodiment, as illustrated in FIG. 10, instead of the capacitor 71 of the fourth embodiment, a surge absorber 74 is electrically connected in parallel with the vacuum valve 8 via the conductive parallel members 72 and 73. The clamping voltage of the surge absorber 74 is set to be equal to or lower than the dielectric strength value of the vacuum valve 8.

(Action and Effect)

According to this embodiment, in addition to the same actions and effects as those of the fourth embodiment, the following actions and effects are accomplishable. That is, by electrically connecting the surge absorber 74 in parallel with the vacuum valve 8, when the transient recovery voltage applied after the fault current is cut off exceeds the clamping voltage of the surge absorber 74, the surge absorber 74 becomes an electrically conducted condition before the vacuum valve 8 causes a dielectric breakdown. Hence, a voltage that exceeds the clamping voltage of the surge absorber 74 is not applied to the vacuum valve 8.

Consequently, most of the voltage to be applied to the switch is shared by the contact of the gas contactor 9 that has a high dielectric strength, thereby improving the dielectric strength performance of the switch.

Sixth Embodiment (Structure)

A sixth embodiment will be explained with reference to FIG. 11. The sixth embodiment employs the same basic structure as that of the first embodiment. Only the difference from the first embodiment will be explained below, and the same component as that of the first embodiment will be denoted by the same reference numeral, and, the detailed explanation thereof will be omitted.

Figure 11:
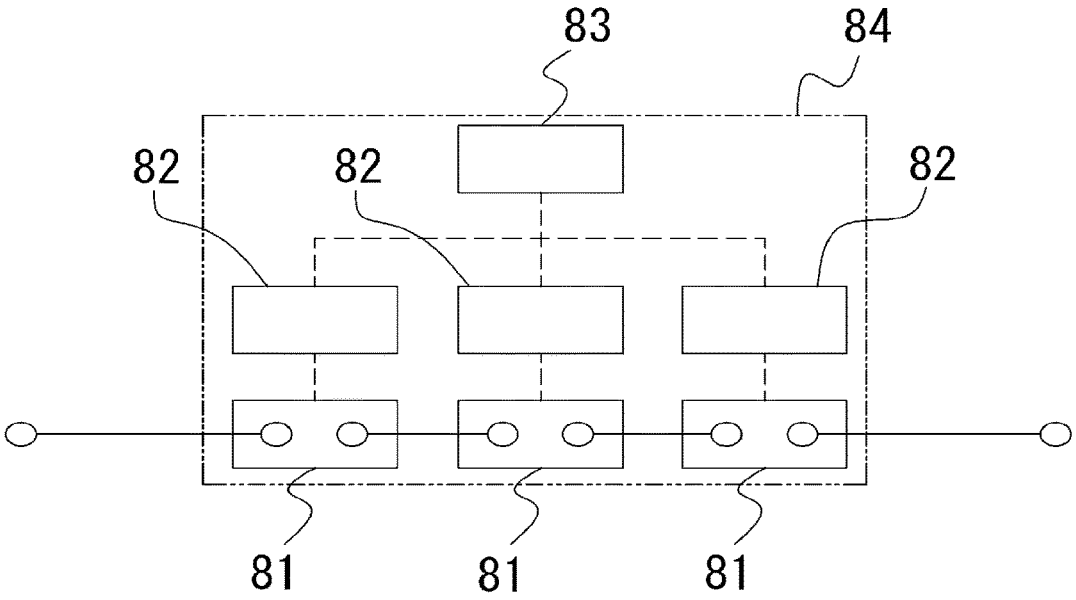
FIG. 11 is a circuit diagram of a switch according to a sixth embodiment.

FIG. 11 is a circuit diagram of a switch according to the sixth embodiment. As illustrated in FIG. 11, a switch 84 of this embodiment includes a plurality of contactors 81, and all operation units 82 for the respective contactors 81 are connected with a single control device 83. The control device 83 monitors the condition of each operation unit 82, and outputs a current cutoff instruction and a current feeding instruction to the individual operation unit 82. The condition of the operation unit 82 may be monitored based on, for example, a current value supplied to the electromagnetic repulsive operation unit 41 of the second embodiment, or the linear operation unit 61 of the third embodiment, or may be monitored by a detector provided so as to detect the position of the movable contact of each contactor 81.

In addition, the switch 84 may be provided with a circuit protector. Example circuit protector are a surge absorber and an lighting arrester.

(Action and Effect)

According to this embodiment, in addition to the same actions and effects as those of the first embodiment, the following actions and effects are accomplishable. That is, by providing the control device 83, a timing at which the contact of each contactor 81 opens and closes are controllable as needed. That is, the current cutoff operations and the current feeding operations of the plurality of operation units 82 which have different performances are synchronizable with one another, and thus the cutoff performance of the switch 84 is improved. In addition, when the plurality of contactors 81 include the vacuum contactor 7 and the gas contactor 9, a current cutoff instruction may be output to the gas contactor 9 after the current cutoff instruction is output to the vacuum contactor 7 in order to maximize both of the performance of the vacuum contactor 7 and that of the gas contactor 9.

In addition, since the control device 83 monitors the condition of each operation unit 81, when all of or some of the operation units 82 become malfunction due to any reason, the reliability of the switch 84 is improved by the circuit protector.

As explained above, according to this embodiment, a switch that has high current cutoff performance and reliability is obtainable.

Other Embodiments

Several embodiments of the present disclosure were explained in this specification, but those embodiments are merely presented as examples, and are not intended to limit the scope of the present disclosure. More specifically, the present disclosure covers a combination of all of or some of the first to sixth embodiments. Such embodiments can be carried out in other various forms, and various omissions, replacements, and modifications can be made thereto without departing from the scope of the present disclosure. Such embodiments and modifications thereof are within the scope of the present disclosure, and also within the scope of the invention as recited in the appended claims and the equivalent range thereto.

(1) For example, in the first embodiment, in the current cutoff operation, the movable electrodes 14 and 18 are simultaneously released from the stationary electrodes 11 and 12 by the actuation forces of the operation units 29 and 30. However, first of all, the movable contact of the movable electrode 14 of the vacuum valve 8 may be released from the stationary contact of the stationary electrode 11 to cut off the flowing current, and then the movable contact of the movable electrode 18 of the gas contactor 9 may be released from the stationary contact of the stationary electrode 12, thereby ensuring the insulation distance between both electrodes 12 and 18.

(2) In the second embodiment, the movable component 54 of the holding mechanism 203 is indirectly connected with the movable shaft 43 of the fast-speed contact open unit 201 via the wiping mechanism 202, but the movable component 54 may be directly connected with the movable shaft 43.

(3) In the fourth and fifth embodiments, the capacitor 71 and the surge absorber 74 are placed in the pressure housing 1, but those may be disposed outside the pressure housing 1, and may be electrically connected in parallel with the vacuum valve 8 by a medium like a conductor passing completely through the pressure housing 1.

(4) In the fourth embodiment, the conductive support 22 is connected with the conductive parallel member 73 so as to connect the capacitor 71 in parallel with the vacuum valve 8, but when the conductive support 22 is formed in a shape that enables the capacitor 71 to be connected in parallel with the vacuum valve 8, the conductive parallel member 73 becomes unnecessary.

(5) In the fourth embodiment, the capacity of the capacitor 71 is determined in consideration of the parasitic capacitance of the vacuum valve 8 and that of the contact of the gas contactor 9, and the dielectric strength value of the vacuum valve 8 and that of the contact of the gas contact 9. However, the capacity of such a capacitor may be determined in consideration of the parasitic capacitance of the contact of the gas contactor 9, and the dielectric strength value of the contact of the vacuum valve 8 and that of the contact of the gas contactor 9. That is, when the capacitance of the capacitor 71 is a, the parasitic capacitance of the contact of the gas contact 9 is b, the dielectric strength value of the vacuum valve 8 is A, and the dielectric voltage value of the contact of the gas contactor 9 is B, the capacitance a of the capacitor 71 becomes $a=b\times(B/A)$. By designing the capacitor capacitance, the voltage to be applied to the vacuum valve 8 becomes lower than that of the contact of the gas contactor 9.

REFERENCE SIGNS LIST

1, 2 Pressure housing
3 Insulative spacer
4, 5 Bush
6 Stationary electrode
7 Vacuum contactor
8 Vacuum valve
8*a* Vacuum housing
9 Gas contactor
11, 12 Stationary electrode
13, 17 Insulative rod
14, 18 Movable electrode
15, 19 Operation rod
16, 20 Sealing member
21, 25 Insulative support
22, 26 Conductive support
23, 27 Conductive terminal
24, 28 Conductor
29, 30 Operation unit
31 Bellows
32, 33 Linkage
34, 35 Supporting member
41 Electromagnetic repulsive operation unit
42 Mechanism box
43 Movable shaft
44 Electromagnetic repulsive coil
45 Repulsive ring
46 Flange
47 Coupler
48 Wiping spring
49 Flange holder
50 Shock absorber
51 Permanent magnet
52 Open-circuit spring
53 Electromagnetic solenoid
54 Movable component
54*a* Protruding portion
54*b* Both hands
55 Shock absorber
56 Holding mechanism box
57 Supporting member
61 Linear operation unit
62 Mechanism box
63 Linear electric motor
64 Fastener member
65 Stator
65*a* External sleeve
65*b* Internal sleeve
66 Movable component
66*a* Three-phase coil
67 External permanent magnet
68 Internal permanent magnet
71 Capacitor
72 Conductive parallel member
73 Conductive parallel member
74 Surge absorber
81 Contactor
82 Operation unit
83 Control device
84 Switch
101 Internal space
102 Internal space

The invention claimed is:

1. A switch comprising:

a sealed housing filled with an insulative medium;

a plurality of contactors each comprising a contact;

a plurality of operation units disposed outside the sealed housing and actuating the contact;

an insulative spacer dividing an interior of the sealed housing into a plurality of internal spaces, a number of the internal spaces being consistent with a number of the contacts; and an electrode passing completely through the insulative spacer, and being fastened to the insulative spacer, wherein;

the contactor is provided one by one for each internal space;

at least one of the contactors includes a linkage which passes completely through the sealed housing while maintaining an air tightness of the interior of the sealed housing, is connected with the operation unit, and transmits actuation force by the operation unit to the contact, wherein among the contactors:

at least one of the contactors comprises a vacuum contactor that comprises a vacuum valve with the contact; and at least one of the contactors comprises a contactor with the contact that has a larger dielectric strength than a dielectric strength of the contact of the vacuum valve, all of the contacts are electrically connected in series via the electrode;

each of the operation units actuates the corresponding contact, the operation unit of at least one of the contactors comprises:

a coil;

a coil fastener fastening the coil;

an opposing conductor provided so as to face the coil;

a movable shaft passing completely through the opposing conductor, and being fastened to the opposing conductor; and a coil exciter supplying a current to the coil, and exciting the coil, and when the coil is excited, repulsive force is generated between the coil and the opposing conductor, and thrust force is applied to the movable shaft.

2. The switch according to claim 1, wherein a capacitor is connected in parallel with the contact of the vacuum valve.

3. The switch according to claim 1, wherein a surge absorber is connected in parallel with the contact of the vacuum valve.

4. The switch according to claim 1, wherein the operation unit further comprises a thrust force generator directly or indirectly connected with the movable shaft, and applying the thrust force to the movable shaft.

5. The switch according to claim 4, wherein the thrust force generator comprises:

a movable component directly or indirectly connected with the movable shaft, and formed of a magnetic material;

a permanent magnet; and an electromagnetic solenoid.

6. The switch according to claim 1, wherein:

the operation unit of at least one of the contactors comprises:

a row of first permanent magnets each being formed in an annular shape or a circular arc shape, the first permanent magnets being adjoined to each other so as to turn a magnetic pole of each of the first permanent magnets 90 degrees by 90 degrees at a maximum on a cross section of the first permanent magnet including a center axis thereof;

a row of second permanent magnets each being formed in an annular shape or a circular arc shape, the second permanent magnets being adjoined to each other so as to turn a magnetic pole of each of the second permanent magnets 90 degrees by 90 degrees at a maximum on a cross section of the second permanent magnet including a center axis thereof;

a double-shell stator causing the first permanent magnet and the second permanent magnet with a radial-direction magnetization vector component in a same direction to face with each other, and fastening the row of the first permanent magnet and the row of the second permanent magnet so as to maintain a constant distance;

a cylindrical movable component comprising a coil located between the row of the first permanent magnet and the row of the second permanent magnet, and being movable in an axial direction of the stator; and a coil exciter supplying a current to the coil to excite the coil, and the movable component actuates the contact.

7. The switch according to claim 1, further comprising a control device connected with each of the operation units, wherein the control device controls a start of a contact opening operation of the operation unit and a contact closing operation thereof.

8. The switch according to claim 1, wherein the insulative medium is an $SF_6$ gas.

9. The switch according to claim 1, wherein the internal space is capable of changing an internal pressure for each internal space.

* * * * *